United States Patent [19]

Massa

[11] 4,096,933

[45] Jun. 27, 1978

[54] COIN-OPERATED VENDING SYSTEMS

[75] Inventor: Frank Massa, Cohasset, Mass.

[73] Assignees: Fred M. Dellorfano, Jr.; Donald P. Massa, Trustees of The Stoneleigh Trust u/d/t, both of Cohasset, Mass.

[21] Appl. No.: 742,192

[22] Filed: Nov. 16, 1976

[51] Int. Cl.[2] ..... G07F 3/02

[52] U.S. Cl. ..... 194/100 A

[58] Field of Search ..... 194/10, 100 A, 100

[56] References Cited

U.S. PATENT DOCUMENTS

| | | | |
|---|---|---|---|
| 2,317,351 | 4/1943 | Andalikiewicz et al. | 194/100 R |
| 3,147,839 | 9/1964 | White, Jr. | 194/100 R |
| 3,491,871 | 1/1970 | Bauer | 194/10 |
| 3,703,229 | 11/1972 | Bowring | 194/10 |
| 3,754,629 | 8/1973 | Douglass | 194/10 X |
| 3,820,642 | 6/1974 | Levasseur | 194/10 X |

*Primary Examiner*—Stanley H. Tollberg

[57] ABSTRACT

A coin-operated vending machine accepts any combination of valid coins which are deposited and automatically returns the correct change when the merchandise is dispensed. The amount of change represents the difference between the total value of the accepted coins and the price of the selected merchandise. A digital data processing circuit is employed for recognizing the validity and denomination of all deposited coins and any unacceptable coin that falls outside the established tolerance limits for a genuine valid coin is automatically rejected and immediately returned.

12 Claims, 2 Drawing Figures

COIN-OPERATED VENDING SYSTEMS

This invention is concerned with improvements in coin-operated vending machines, and, more particularly, with the improvements in the efficiency of operation of the vending machine whereby any combination of coins may be inserted to make a purchase, and if the inserted coins exceed the purchase price, the correct change is returned by the machine automatically when the merchandise is dispensed. Heretofore, the correct amount of coin deposit must be made before merchandise may be dispensed and this decreases the utilization of the prior art coin-operated vending machines by potential customers who do not have the exact change available for making the purchase. By providing an automatic change making mechanism, the inventive machine will permit the pricing of the merchandise by any odd value, such as eight cents, for example, instead of multiples of nickels, dimes and quarters, and any taxable amount required for any purchase can readily be added to the base price instead of being absorbed in the pretax price or require the increase in price by an even nickel because of the inconvenience of adding pennies to the price in the conventional prior art machines.

Because of the fact that Applicant's machine automatically returns change when the price of the merchandise is less than the value of the deposited coins, a very important feature of the inventive machine is its exceptional capability to recognize and reject counterfeit coins or slugs; otherwise the new automatic change making vending machine would become an illegal means for converting counterfeit coins into genuine money.

An object of the invention is to provide means in a coin-operated vending machine for receiving any combination of coins and recognizing the sum total value of the number of coins deposited.

Another object of the invention is to return any deposited coin which is not recognized as valid currency.

A still further object of the invention is to provide control means for causing the merchandise dispensing mechanism to become operative only when the total value of the deposited valid coins equals or exceeds the price of the selected merchandise.

Another object of the invention is to return as change the difference between the deposited amount and the price of the merchandise when the deposited amount exceeds the price of the merchandise.

A further object of the invention is to provide positive means for recognizing genuine coins and their denominations by sensing the free resonant frequency of each coin while it is in motion during its trajectory through the machine, and instantly recognizing the precise magnitude of its resonant frequency.

A still further object of the invention is to provide an electronic coin validation and classification system with provisions for accumulating and totalizing the value of the validated coins being deposited.

Another object of the invention is to prevent the operation of the merchandise dispensing mechanism unless the total value of the accumulated valid coins is equal to or exceeds the price of the merchandise to be dispensed.

These and other objects of the invention will become evident in the following detailed description. The novel features which are characteristic of the invention are set forth with particularity in the appended claims. The invention itself, however, both as to its organization and method of operation, as well as advantages thereof, will best be understood from the following description of a preferred embodiment thereof when read in connection with the following drawings:

FIG. 2 also shows a schematic block diagram of an electronic system which may be employed to achieve the stated objects of this invention.

Figure 1:
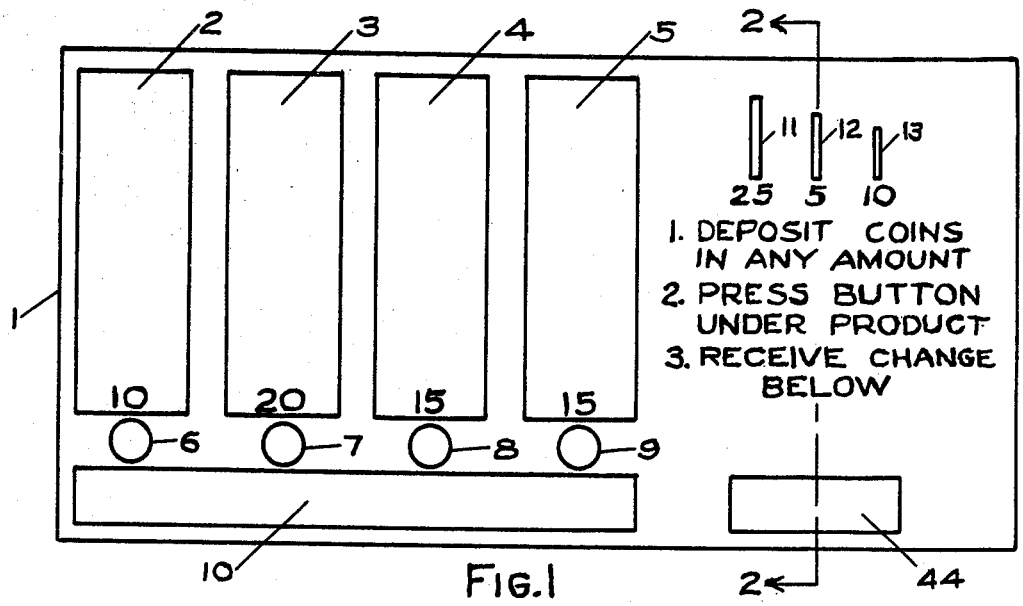
FIG. 1 is a schematic illustration of the front view of a vending machine incorporating a preferred embodiment of the invention.

Referring more specifically to the drawing, the reference character 1 illustrates the main housing structure which contains the complete vending machine system. A plurality of merchandise storage sections which include transparent windows for viewing the merchandise, such as are in widespread use in conventional prior art vending machines, are illustrated by 2, 3, 4 and 5. The numerals shown near the bottom of the front window portions of the separate merchandise storage sections represent the prices of the different commodities enclosed. The push buttons 6, 7, 8 and 9 permit the selection of the merchandise displayed in the various storage sections. An opening 10 provides access for picking up the dispensed merchandise when it is released.

Three coin deposit slots 11, 12 and 13 are provided as illustrated and each slot is dimensioned for receiving a coin of different denomination; such as, for example, 25, 5 and 10 cents respectively, as marked by the numerals beneath the slots. It is obvious that additional slots could be provided to receive coins of other denominations or even of other currencies, if desired. The opening 44 permits access for picking up coins that are returned during the operation of the machine. Thus far, the description of the vending machine has included only well known components such as are utilized in conventional prior art machines which are in widespread general use. The inventive combination of a novel electroacoustic system with a conventional vending machine to achieve the objects of this invention is illustrated in the schematic drawing shown in FIG. 2.

When a coin 16 is inserted in the slot 12 it falls along a trajectory illustrated by the dashed line 13 and eventually strikes the surface of a rigid plate member 14, which is positioned so that its strike surface is perpendicular to the plane of the falling coin so that after the coin strikes the plate, it continues along the trajectory 15. At the moment of impact of the coin 16 on the surface of the plate member 14, the coin is set into vibration at its natural free resonant frequency mode so that while it is in flight along the trajectory 15, it is radiating sound at a frequency corresponding to its free natural resonant mode of vibration.

The natural frequency of vibration of the coin 16 is an exact function of its thickness and diameter as well as the density and modulus of elasticity of the alloy used in the manufacture of the coin. Because the natural frequency of vibration is precisely dependent on the magnitudes of all these various parameters, it follows that the natural resonant frequency of a counterfeit coin will be different from the natural frequency of a valid coin unless the counterfeit coin has the identical physical properties of the alloy used in the genuine coin and the dimensions of the counterfeit coin are identical to those of the genuine coin. Therefore, the natural resonant frequency of the coin will be used in this invention as an accurate means for establishing the validity of a coin after it has been inserted in the machine.

Figure 2:
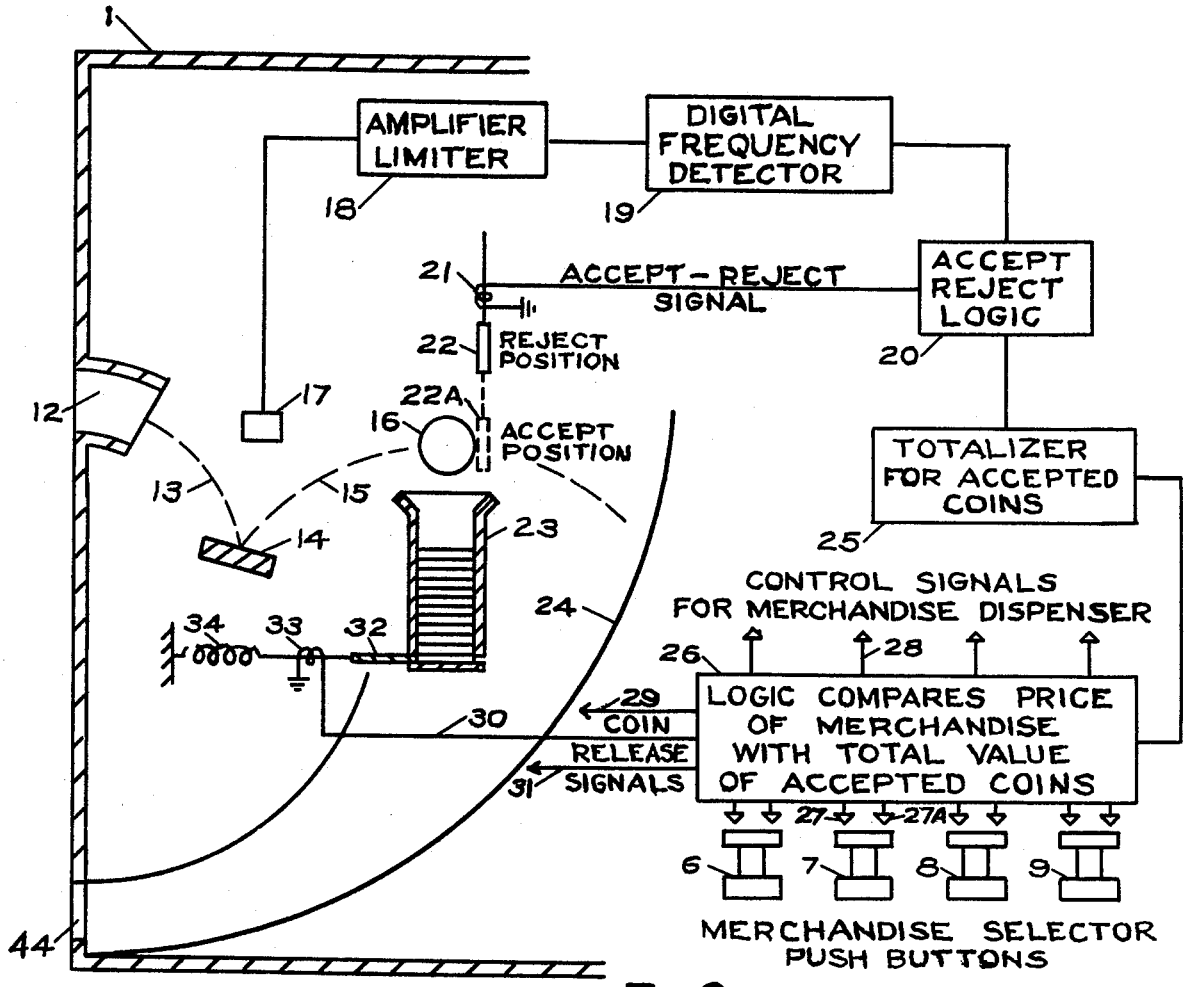
FIG. 2 is a schematic view of a cross section of the machine taken along the line 2—2 of FIG. 1.

The schematic block diagram in FIG. 2 illustrates an electroacoustic system for measuring the natural frequency of vibration of the coin after it is deposited and then making an electronic decision to accept or reject the coin based on the measured value of its resonant frequency. A microphone 17 picks up the sound radiated from the vibrating coin during its trajectory 15 after striking the plate 14. The electrical output signal from the microphone 17, whose frequency corresponds to the resonant frequency of the vibrating coin, is amplified and converted to a square wave by the amplifier-limiter 18. Circuits for converting the microphone sinusoidal output signals to square waves of the same frequency are very well known in the electronic art and the specific circuit details are not shown because they are not a part of this invention. The output square wave signal from the amplifier-limiter, whose frequency corresponds to the free resonant frequency of the coin 16, is fed into a digital frequency detector 19 which converts the square wave signal, which is representative of the frequency of vibration of the coin 16, into a digital signal which is exactly proportional to the frequency of vibration of the coin. This is accomplished by conventional well known circuits which generally include a crystal controlled oscillator as a precision high frequency source usually in the megacycle range, which serves as a standard clock whose precise high frequency output signal is used as a base line reference for generating a digital signal which is proportional to the free resonant frequency of the coin 16. The digital signal is generally derived by counting the number of high frequency clock oscillations which occur between successive zero crossings of the square wave signal output from the amplifier-limiter 18. Specific circuit details for generating the digital signal which represents the free resonant frequency of the coin are not shown because they are well known in the electronic art and the specific circuit details do not form a part of this invention.

The output digital signal from the digital frequency detector 19 is transmitted to a logic circuit 20 which is programmed to accept the coin if the digital signal input is within the acceptable prescribed tolerances corresponding to the resonant frequency limits established for an acceptable valid coin. Based on whether an ACCEPT or REJECT decision is made by the logic circuit 20, either an ACCEPT or REJECT signal will be transmitted to a reject-accept mechanism, as illustrated by the solenoid 21 and associated moveable shutter 22. If the logic output signal indicates that the coin should be rejected because the measured resonant frequency of the coin is outside the tolerances established for a valid coin, the signal level supplied to the solenoid 21 will cause the shutter 22 to remain in the reject position, as illustrated in FIG. 2. When the shutter 22 is in the reject position, the coin 16, which is in flight along the trajectory 15, will continue uninterrupted along its trajectory and overshoot the coin storage chamber 23 as illustrated in FIG. 2 and the rejected coin will fall into the chute 24 and will be returned to the bottom of the chute in the vicinity of the open window 44 where it can be retrieved. If the logic output signal indicates that the coin should be accepted because the measured resonant frequency of the coin is within the tolerances established for a genuine coin, the signal level supplied to the solenoid 21 will cause the shutter 22 to move to the accept position, as illustrated by 22A. When the shutter is in the accept position 22A, the coin 16 will be stopped in its trajectory, as illustrated in FIG. 2, and the coin will drop and become stacked within the coin storage chamber 23. It is preferable to use a layer of felt or other energy absorbing material applied to the surface of the shutter 22 so that the accepted coin stops dead upon impact and drops directly down into the coin storage chamber 23.

When a coin is accepted by the logic circuit 20, a signal is transmitted from the logic circuit to the totalizer 25. The totalizer circuit includes a register which accumulates the total value of all the accepted coins which are being dropped into the machine for the intention of making a purchase. The output signal from the totalizer, which is representative of the total value of the accepted coins, is transmitted to a logic circuit 26 whose function is to compare the total value of the accepted coins which have been deposited with the price of the selected merchandise contained within the storage compartment associated with the push button selector knob being depressed. If the push button 7, for example, is depressed, the logic circuit 26 will compare the total value of the accepted coins as represented by the output signal from the totalizer 25 with the price of the selected merchandise in storage compartment 3 as represented by an internal signal generated by the closure of electrical contacts 27 and 27A. If a decision is made by the logic circuit 26 that the total value of the accepted coins is equal to or greater than the price of the merchandise selected by pressing selector push button 7, a control signal will be sent from terminal 28 to the operating mechanism of the corresponding dispenser compartment 3, and the merchandise therein will be delivered from the storage compartment and will appear inside the window 10. If the total coin value deposited exceeds the price of the merchandise dispensed, the logic circuit 26 will determine the difference, and coin release signals will be transmitted along the conductors 29, 30 and 31 to activate the appropriate coin storage chambers to cause the ejection of the required coins to provide the correct change. The coin release signals which are transmitted from the logic circuit 26 along the conductors 29, 30 and 31, as illustrated in FIG. 2, will go to the three separate coin storage chambers used in the illustrative example described in this application. Conductor 29 is connected to the coin ejection mechanism on the coin storage chamber containing quarters, which is not shown in the view in FIG. 2, but which is located directy behind coin storage chamber 23 at a spacing corresponding to the center line distance between coin slot openings 11 and 12 shown in FIG. 1. Conductor 31 is connected to the coin release mechanism on the coin storage chamber containing dimes, which is also not shown in FIG. 2 but would be located next to coin storage chamber 23 and spaced therefrom by the center line distance between slots 12 and 13 in FIG. 1. Conductor 30 is connected to the coin ejection mechanism associated with coin storage chamber 23 as shown in FIG. 2. The coin release mechanism is schematically illustrated by a push rod 32 operated by the transmission of a signal to the solenoid 33, which will cause the push rod 32 to move to the right in FIG. 2 and push out the bottom coin from the stack of coins contained in the storage chamber 23. The ejected coins will fall into the chute 24 and be delivered at the window 44. A spring 34 returns the push rod 32 back to its original position as shown in FIG. 2 after the coin is ejected, whereupon the stack of coins in the chamber 23 drops by an amount equal to the thickness of the coin which has been ejected thus making another coin available for ejection upon the transmission of the appropriate signal from logic circuit 26 along the conductor 30. The coin release signals transmitted from the logic circuit 26 will activate any required combination of ejector mechanisms associated with the different coin storage chambers to accomplish the delivery of the exact change required for the transaction.

The various logic circuits that have been described in connection with the operation of the inventive vending system employ standard digital circuit combinations that are well known in the electronic art and are not specifically part of this invention. In fact, most of the functions illustrated by the blocks 19, 20, 25 and 26 may be combined within a microprocessor and the microprocessor can be easily programmed by any one skilled in the digital electronic art to accomplish all the functions that have been described.

If the price of the selected merchandise is greater than the total value of the accepted coins, the total amount deposited will be released by the logic circuit 26 when the push button selector switch is closed and no merchandise will be delivered. By using a microprocessor as part of the electronic system, it can easily include a program to display a statement on a small screen that notifies the customer that an insufficient amount was deposited to cover the purchase and the total amount deposited is being returned.

Other features may be easily incorporated in the software program associated with the microprocessor. For example, if an insufficient number of coins of a particular denomination are contained in the coin storage chamber than are needed to make the correct change, the microprocessor can decide to make change by different denominations of coins if possible. If there is no possibility for making up the correct change the merchandise will not be dispensed and the total amount deposited will be returned. For such a situation a statement can be made to appear on the electronic screen notifying the customer that sufficient coins are not available for making up the correct change. Additionally, another statement could be made to appear to indicate that another combination of coins be tried to make the purchase in which case a different amount of change might become available from the denominations of the coins that are present in the machine. Any of the indicated programs as well as any others that may be desired can be easily designed and made part of the electronic circuit by anyone skilled in the art. The specific circuit details or software details are not shown in this application because they are not in themselves part of this invention. This invention is only concerned with the novel combination of an electroacoustic and electronic system with a conventional coin-operated vending machine as described to provide a new coin-operated vending machine to achieve the objects of the invention and provide a system that can be operated by inserting any combination of coins and the change will automatically be provided.

In addition to achieving the primary object of this invention, which is to improve the operational efficiency of a coin-operated vending machine by providing an effective automatic means for the rejection of counterfeit coins and permitting the use of coins in any combination and for any amount in operating the machine and automatically receive the correct change whenever the total deposited amount exceeds the price of the merchandise, the novel inventive system permits additional desirable features to be programmed into the digital circuits which comprise the electronic system described in the specification. For example, it is possible to provide a gravity operated switch at the bottom of each merchandise storage compartment which is wired into the digital circuits or microprocessor to provide signal means for indicating when the merchandise is sold out of a compartment; and when an item is sold out the logic circuit 26 can provide coin release signals to instruct the coin release mechanisms to return the price of the merchandise which has been sold out.

In order for the automatic vending machine herein described to be reliable it must insure against errors in making change such as might result if no merchandise is delivered or if one or more of the coin storage compartments are empty or if coins of wrong denominations are inserted into a coin deposit slot such as, for example, when a dime is mistakenly deposited into the quarter deposit slot. The proposed use of digital circuits or microprocessor as described will permit the programming of the circuits or microprocessor to retain in its memory bank whatever information is required to accomplish the various functions necessary to insure the degree of reliability desired for the system operation. For example, suppose that the dime storage compartment is empty and a dime is required for change, a sensor placed in each coin storage compartment which recognizes the number of coins in each compartment when they fall below some predetermined number sends signals to the logic circuit which continuously indicates the available number of remaining coins in each compartment. Many sensors are well known for performing this function. For example, a spring loaded platform may be placed at the bottom of the coin compartment which rises and falls in proportion to the weight of the last few remaining coins. The position of the platform can be correlated to the position of the slider on a potentiometer or to the position of a multiple contact switch which in turn controls the magnitude of the signal level in the memory bank which will in turn represent the number of coins remaining in each compartment. With the availability of this information it is a routine procedure to include a program in the microprocessor to make an instant decision whether any combination of available coins can be used to make the proper change required for the purchase. The merchandise will only be dispensed if the required coins for making the change are available, otherwise the decision will be made to return the amount deposited instead and the merchandise will not be dispensed. It will also be possible to cause a message to appear on an electronic screen informing the customer that it cannot make up the required change and request a deposit of a different combination of coins. It would be equally possible to print out what different combinations of coins would be acceptable for making the desired purchase and for which the correct change can be supplied by the machine.

A preferred embodiment of well known electroacoustic and electronic elements has been described in a novel combination with a conventional coin-operated vending machine to achieve the improved vending system herein disclosed. It is obvious to those skilled in the art that many variations of the basic disclosure can be made and additional features can be programmed into the system without departing from the fundamental teachings of this invention; therefore the appended claims are to be construed broadly enough to cover all equivalents falling within the true scope and spirit of the invention.

I claim:

1. In combination in a coin-operated vending system, a plurality of storage sections containing a plurality of dispensable items, a plurality of openings for receiving a plurality of coins of different denominations, guide means associated with said openings for directing the trajectory of a coin after a coin is deposited in one of said openings, means located along the trajectory of said coin for causing said coin to vibrate at its resonant frequency mode, said means including a rigid plate positioned with one surface of said plate perpendicular to the plane of the trajectory so that the edge of the coin strikes said surface while the coin is falling during the initial stage of its trajectory and while the plane of the coin is at right angles to said rigid surface at the moment of contact, sensor means responsive to said resonant frequency mode of said vibrating coin, frequency measurement means associated with said sensor means, frequency classification means associated with said frequency measurement means, said frequency classification means characterized in that each different coin is separately classified in accordance with its different resonant frequency mode of vibration, means for returning said deposited coin if said frequency classification means indicates that the measured resonant frequency of said coin lies outside the established normal frequency range of vibration for an acceptable valid coin, coin identification means characterized in that the denomination of said deposited coin is identified from the measured resonant frequency of said coin if the resonant frequency lies within the acceptable frequency range established for an acceptable valid coin, coin storage means for holding acceptable valid coins which have been so recognized by said coin identification means, totalizing means characterized in that a signal is generated by said totalizing means which is representative of the total value of the accepted coins, merchandise dispensing means associated with said plurality of storage sections, control means for selectively operating said plurality of storage sections for the dispensing of a desired item, said selectively operable control means characterized in that it is activated only when the totalizer signal, which is representative of the total value of the accepted coins, indicates that the total value of the accepted coins equals or exceeds the price of the selected item of merchandise to be dispensed.

2. The invention in claim 1 and a coin dispensing means, said coin dispensing means including coin selection means responsive to the difference between the value of said accumulated coins and the price of the merchandise selected to be dispensed, and means for returning said selected coins from said coin dispensing means, said returned coins representing the difference between the value of the deposited accepted coins and the price of the merchandise dispensed.

3. The invention in claim 1 characterized in that said coin storage means includes a plurality of compartments and further characterized in that different compartments are used for receiving coins of different denominations.

4. The invention in claim 3 and a coin dispensing means, said coin dispensing means including coin selection means responsive to the difference between the value of said accumulated coins and the price of the merchandise selected to be dispensed, and means for returning said selected coins from said coin dispensing means, said returned coins representing the difference between the value of the deposited accepted coins and the price of the merchandise dispensed.

5. The invention in claim 2 characterized in that said coin dispensing means is additionally responsive to the actual delivery of the selected merchandise from its storage section and further characterized in that said coin dispensing means includes operable means for returning the full amount of the accepted deposited coins if the merchandise is not delivered.

6. The invention in claim 4 characterized in that said coin dispensing means is additionally responsive to the actual delivery of the selected merchandise from its storage section and further characterized in that said coin dispensing means includes operable means for returning the full amount of the accepted coins if the merchandise is not delivered.

7. The invention in claim 6 further characterized in that sensor means are associated with said plurality of coin storage compartments, said sensors characterized in that they provide signals indicating the availability of coins of each denomination in said different coin storage compartments, and signal processing means adapted for receiving said coin sensor signals and transmitting a logic signal to prevent the activation of said merchandise dispensing means whenever a coin of a particular denomination which is required for providing the correct change is depleted from said coin storage compartments.

8. The invention in claim 7 characterized in that a lighted statement is displayed indicating that the deposited coins are being returned because the exact change cannot be delivered.

9. The invention in claim 8 further characterized in that a lighted statement is displayed indicating that a different combination of coins be deposited for which the exact change can be furnished.

10. The invention in claim 1 characterized in that said frequency measurement means includes a digital frequency detector.

11. The invention in claim 1 characterized in that the trajectory of said coin is interrupted after the coin strikes the surface of said rigid plate if the resonant frequency of the coin lies within the acceptable frequency range established for a valid coin.

12. The invention in claim 11 further characterized in that the interruption of the trajectory of said coin is accomplished by the automatic introduction of a barrier along the path of the coin which stops the coin in flight causing the coin to drop into said coin storage means for holding validated coins.

* * * * *